United States Patent [19]

Sain

[11] 4,113,260

[45] Sep. 12, 1978

[54] SIMULATED GOLF GAME AND MATERIALS THEREFOR

[75] Inventor: Paul E. Sain, Salt Lake City, Utah

[73] Assignee: Games Research Associates, Salt Lake City, Utah

[21] Appl. No.: 769,557

[22] Filed: Feb. 17, 1977

[51] Int. Cl.[2] ..... A63F 3/00

[52] U.S. Cl. ..... 273/245; 273/141 R

[58] Field of Search ..... 273/134 C, 134 D, 134 E, 273/134 CB, 134 DB, 134 ES, 134 AG, 134 CG, 245

[56] References Cited

U.S. PATENT DOCUMENTS

| | | | |
|---|---|---|---|
| D. 107,160 | 11/1937 | Schuster | 273/134 CG |
| 811,347 | 1/1906 | Whitlatch | 273/134 CG |
| 1,513,941 | 11/1924 | Smith | 273/134 CG |
| 1,520,725 | 12/1924 | Seagrave | 273/134 CG |
| 1,605,739 | 11/1926 | Jennings | 273/134 CG |
| 1,638,365 | 8/1927 | Ryan | 273/134 CG |
| 1,758,581 | 5/1930 | Morch | 273/134 CG |
| 1,800,285 | 4/1931 | Dowling | 273/134 CG |
| 3,260,526 | 7/1966 | Seitz | 273/134 CG |
| 3,771,792 | 11/1973 | Crumlish | 273/134 CG |
| 3,857,568 | 12/1974 | Yoder | 273/134 CG |
| 3,910,581 | 10/1975 | Nicholson | 273/134 CG |

FOREIGN PATENT DOCUMENTS

| | | | |
|---|---|---|---|
| 1,362,651 | 8/1974 | United Kingdom | 273/134 CG |
| 385,098 | 12/1932 | United Kingdom | 273/134 CG |
| 737,062 | 9/1955 | United Kingdom | 273/134 CG |

*Primary Examiner*—Richard C. Pinkham
*Assistant Examiner*—Harry G. Strappello

[57] ABSTRACT

A game simulating the outdoor game of golf. Game equipment, to accommodate one to eight players, includes 18 playing boards simulating respective hole areas on a golf course, two hazard, green and putt spinners, eight dice, nine playing pieces, eight stroke counters, a plurality of skill cards, usually 120, and two reusable score cards, two score pencils, and two score card sloths to remove pencil markings on the score cards. The game pieces, equipment, playing boards, and indicia and markings are engineered in accordance with laws of mathematical probability such that realistic scores are obtained as though the players were actually on a golf course. Thus, close correlation and simulation of actual conditions, objects and scores, is achieved, this by virtue of the relationship and correlation of physical materials and components with printed indicia.

4 Claims, 8 Drawing Figures

© 1977 by Games Research Associates

SIMULATED GOLF GAME AND MATERIALS THEREFOR

FIELD OF INVENTION

The present invention relates to indoor games simulating outdoor sports, such as golf, and, more particularly, provides a uniquely engineered game having a specialized playing board and equipment associated therewith, so that game players can experience as closely as possible various conditions, anxieties, and emotions, as would be enjoyed by the players were the same actually on a golf course. The game apparatus is engineered so that realistic golf scores are attainable, and stroke numbers for the various holes are realistic, and this notwithstanding the chance elements introduced by virtue of dice and spinner cards. Broadly, the field of invention with which the present invention is concerned includes parlor games of many types employing dice, advanceable markers, game boards, and/or other chance and associated elements. The game differs, e.g., in that there is a new, close, and unusual relationship as between physical objects and markings or indicia on the various game paraphernalia, this so that simulated experiences can be made very realistic when playing the game.

DESCRIPTION OF PRIOR ART

There are, of course, many types of games on the market using game boards, advanceable dice, markers, and so forth. Few of these simulate actual experiences encountered in life, and none, to the inventor's belief and information, pertain to the game of golf wherein the game boards utilized are realistically and yet uniquely laid out so that, even with the chance elements included, realistic experiences can be had in playing the game.

No United States or foreign patents are presently known which bear upon the important teachings of the game under discussion.

BRIEF SUMMARY OF THE INVENTION

The subject game herein which simulates the game of outdoor golf, includes a series of playing boards, one for each hole, with the playing boards being laid out and allied equipment designed in the manner simulating actual fairways and greens that might be experienced out of doors. Advance markings and grids on the playing boards are appropriate for suitable marker advance, depending upon the hole and the type of stroke called for. Challenging hazards are emplaced on the game boards and brought into play as hereinafter pointed out. Handicaps are worked out and challenges provided so that "par" scores are possible. The construction of the spinner and its format, in combination with the grids and advance markings on the holes layouts, are mathematically correlated to assure realistic experiences through playing the game.

OBJECTS

A principal object of the invention is to provide a new and useful, and instructive, simulated golf game.

A further object is to provide a golf game incorporating a series of game boards, unique pointer apparatus, and other paraphernalia wherein close correlation of scoring, advance, and hazards, to the actual game of golf is maintained.

A further object is to provide a relationship between physical objects used in the game and printed indicia incorporated therein, whereby such relationship ensures close correlation or simulation with an actual game of golf where the subject equipment is utilized.

DESCRIPTION OF PREFERRED EMBODIMENTS

Figure 1:
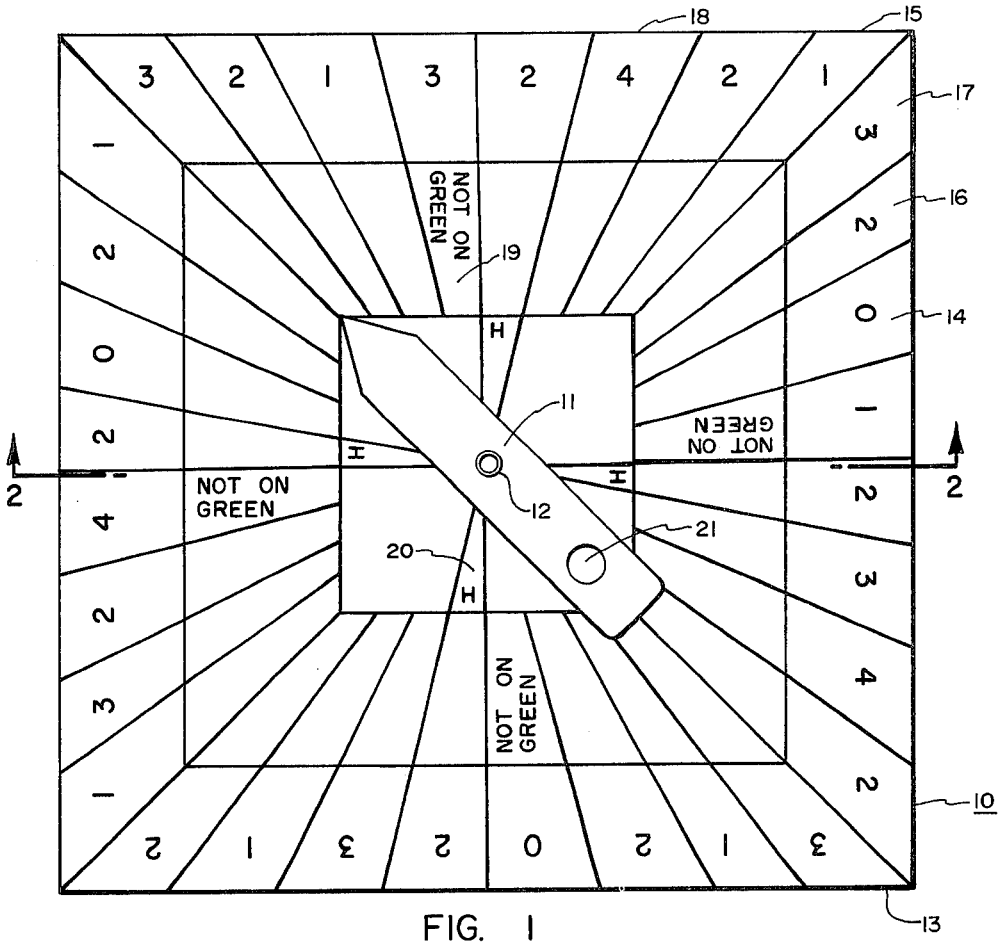
FIG. 1 is a plan view of a hazard, green and putt spinner card utilized in the invention.
Figure 2:
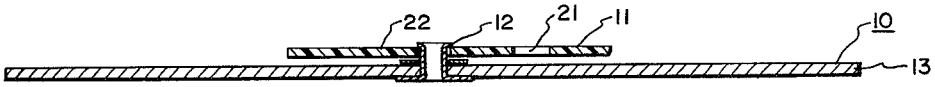
FIG. 2 is a transverse section taken along the line 2—2 in FIG. 1.

As to the game apparatus, FIGS. 1 and 2 illustrate a representative one of the hazard, green, and putt spinner cards 10, the same including a spinner 11 joined by eyelet rivet 12 to card 13. On the card 13 are a series of zones 14–18, each bearing a respective indicia 0–4 as shown. Also indicated are zones "Not On Green" 19 and also zones "H," standing for hazard, at 20. The spinner 11 includes a viewing aperture 21 for disclosing when hazard area 20 bearing indicia H is reached. Washer 22 can be employed, if desired, for the spinner 11.

Figure 3:
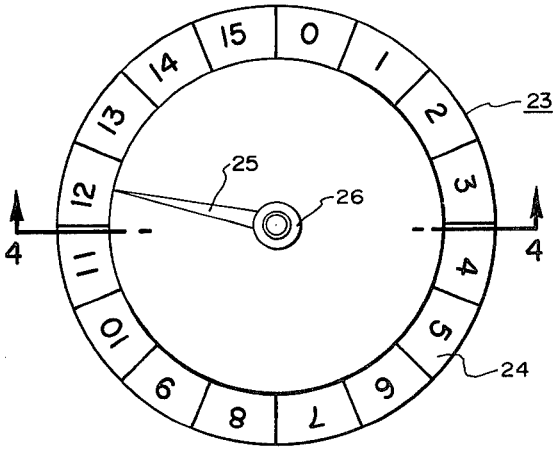
FIG. 3 is a plan view of a stroke counter device utilized in the invention.
Figure 4:
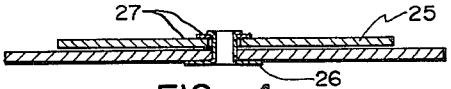
FIG. 4 is a transverse section taken along the line 4—4 in FIG. 3.

FIGS. 3 and 4 illustrate a stroke counter 23 having outer numeral indicia along peripheral margin 24 bearing zone numbers 0–15, as indicated. A pointer 25 is manually movable and is mounted to the structure by eyelet rivet 26 and incorporates washers 27.

Figure 5:
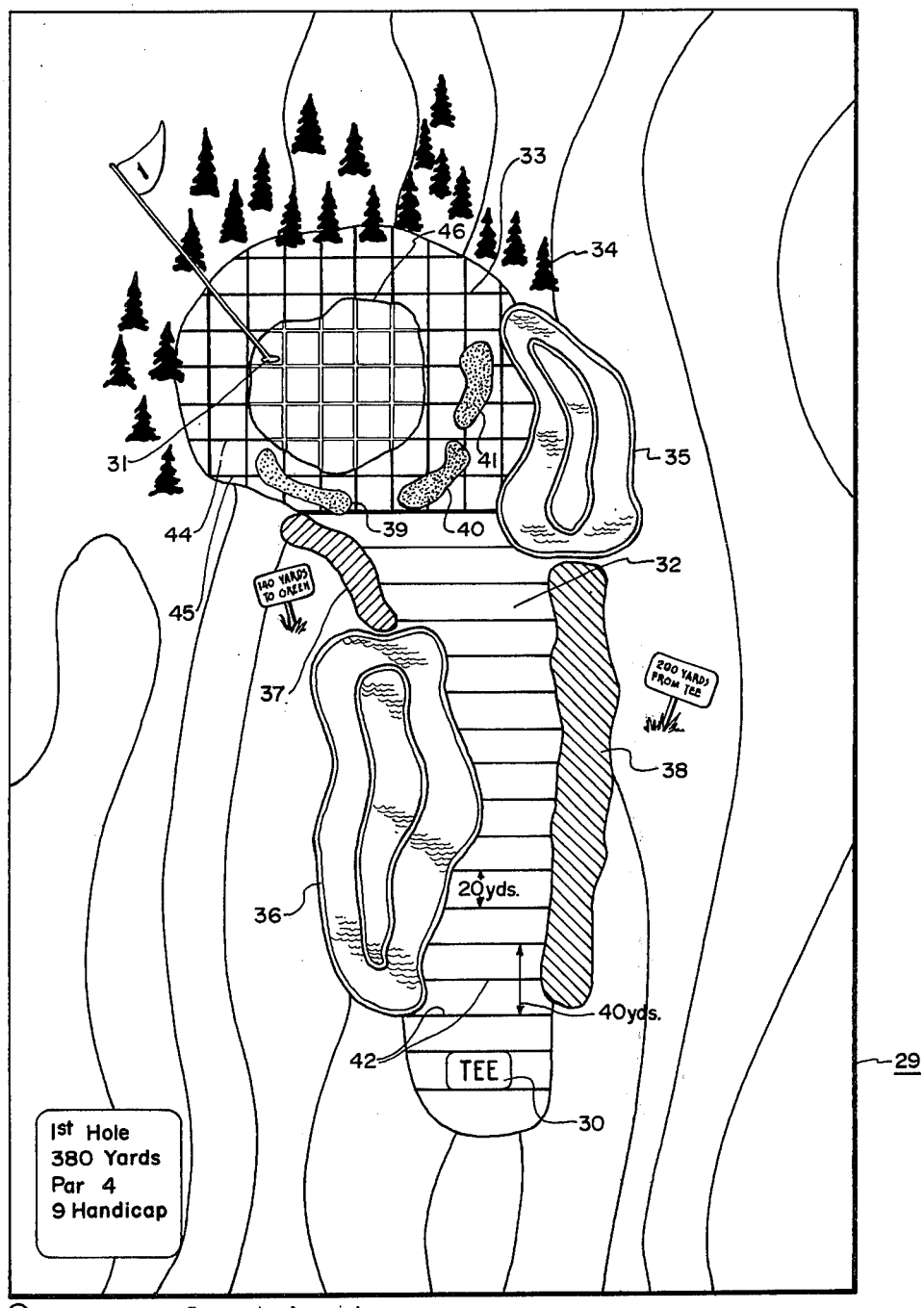
FIG. 5 is a top plan of a selected game board illustrating course layout for a particular hole.

FIG. 5 illustrates a game board 29 having a series of indicia, including tee zone 30, hole 31, fairway 32, green 46, surrounding area 33, forest area 34, lake areas 35,36, rough areas 37,38, and sand trap areas 39–41.

Fairway bar lines 42 are seen, these being constructed preferably to simulate 20-yard distances between adjacent parallel bars 42. Horizontal and vertical grid markings 44 and 45, may simulate similar distances by way of example, at areas approaching the green 46 of the game board. Various areas on the game board are assigned different degrees of difficulty. In accordance with standardized play on a natural golf course, landing in the "rough" presents an assigned lower or first (1) degree of difficulty in advancing therefrom toward the hole. A sand trap, being more difficult to get out of, is assigned a difficulty of 2. When the ball lands in a river or lake area, there is realistically assigned a difficulty factor of 4 since one stroke is lost. For an out-of-bounds ball, there is assigned a difficulty factor of 8, since on a representative golf course both stroke and distance are lost. These various difficulty factors or elements are factored into the elements and apparatus of play.

The grid lines or bars at 42 on the fairway and at 44 and 45 proximate the green taken into consideration the reachability aspect of the game For example, and mathematically, the probability or mathematical mean of one die rolled an infinite number of times approaches 3.5. There is where, through probability laws, we divide the total number of points or dots appearing on an upper surface of the die for an infinite number of successive throws by the number of throws thereof. Mathematically, for two dice the mean probability is 7 or seven dots or points; for three dice, mathematically, it becomes 10.5; and for four dice the mean number is 14. Again, this means that if one rolls four conventional dice either simultaneously or consecutively, the probability is greatest that the combined readings of the uppermost surfaces of the dice will equal 14.

From the particular holes seen in FIG. 5, one would have to advance from the tee 340 yards, in two strokes, to make the green. This is an average of 170 yards for each of the first two strokes, namely, the drive from the tee and a wood shot from the fairway, for example. Accordingly, the average mean for three dice is 10.5, times the 20-yard intervals in FIG. 5, or a total of 210 yards for the drive, an average "rear" drive, by way of example. Of course, if the player chooses he might play four dice on the drive and, if he rolls the mean or combined number of greatest probability, a total of 14 dots would appear on the upper faces of the dice, which, multiplied by 20 would give a 280-yard drive for the first shot. This is sufficient at this point to indicate that the course and the materials used, with the rules, operate on certain mathematical principles which will give results approximating actual play on the golf course.

Figure 6:
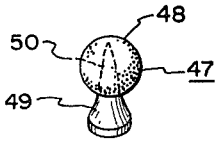
FIG. 6 is a perspective view of a representative marker used herein.

In FIG. 6, a representative marker 47 is seen which may include a Styrofoam ball 48 pierced by an inverted golf tee 49. To simulate the actual appearance of a golf ball the Styrofoam ball 48 can be simply coated with a light enamel or other paint. It is seen that the golf tee is inserted in its self-made aperture 50 within the ball.

Figure 7:
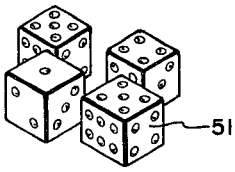
FIG. 7 illustrates four dice used in the game.

FIG. 7 illustrates four dice; it will be understood that one to four dice will be used in the operation or play, each die being referred to by a representative number 51.

Figure 8:
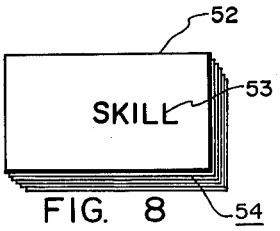
FIG. 8 illustrates in plan representative skill cards.

A series 54 of skill cards 52 are employed, a representative one being seen in FIG. 8. The same will preferably have the actual term "skill" at 53 disposed thereon.

The importance and thrust of the game will become even more apparent upon a review of the instructions for playing the game which now follow, the game being suitable for from one to eight players:

GAME INSTRUCTIONS (Protour (c) 1977 by Games Research Associates)

OBJECT

To play the course and get a lower score than the other players. If a player is playing alone he should set 72 (Par) as his goal.

BEFORE PLAY

Each player should receive the following:

(1) 14 Skill Cards if 18 holes are to be played. Seven skill Cards if only nine holes are to be played.

(2) One Stroke Counter.

(3) One Playing Piece.

One player should be assigned to keep score. The scorer should write the names of the players down the left side of the score card in the spaces provided. The number of strokes per hole is recorded to the right of the player' names and beneath the corresponding hole number. Spaces are provided on the score card for nine and 18 hole totals.

EXPLANATION OF PLAYING EQUIPMENT

18 Playing Boards — represent an 18-hole golf course. Each board represents a different hole.

Hazard, Green and Putt Spinners — serve three purposes:

(a) The inside section determines whether a player's ball has landed in a hazard or not.

(b) The middle section determines whether a player's ball has landed on the Green or not.

(c) The outside section determines the number of putts a player takes before his ball goes in the hole.

The Stroke Counter — helps each player count how many strokes he uses for each hole. After each player's score has been recorded for a hole, the stroke counter is re-set for the next hole.

Skill Cards — are used to remove the playing pieces from hazards along the golf course without being penalized. They may also be used to land your playing piece on the Green when the spinner indicates that you are "not on the Green."

A Skill Card may be used at the Tee when a player wishes to roll four dice instead of the usual three dice. This would be used on an especially long hole where the player wishes to attempt to gain more yardage. This may only be done off the Tee of a hole.

A player may wish to use up all his Skill Cards at the beginning of the game or use them throughout the game on only the worst hazards. When his Skill Cards are all used, the player must take all penalties from the hazards he lands in which may add extra strokes to his score.

If Skill Cards are left over at the end of the game, the number of unused Skill Cards is deducted from the player's score, giving the player a lower score.

Skill Card Exception — If on the approach to the Green the player goes past the Green and outside the playing area, he may not use a Skill Card to nullify the lost ball penalty. He must take the lost ball penalty.

Playing Pieces — represent each player's golf ball. They are moved along the course grid beginning at the Tee of each hole and ending on the Green of each hole. More than one playing piece may occupy the same movement space at the same time.

Dice — determine the number of spaces each person moves his playing piece during his turn. The playing pieces are moved one space on the playing board for every dot shown on the dice after the player has rolled them.

Each player may use one, two or three dice when rolling for his turn. The farther he is from the Green the more dice he would use. The closer he is to the Green the fewer dice he would use. Four dice may be used at the Tee only if a Skill Card is played.

Each space along the course grid represents 20 yards.

Each roll of the dice counts one stroke. A player arrives at his score for each hole by adding the number of times he has thrown the dice with the number of penalty strokes (if any) and the number of putts he spins.

HAZARDS

Hazards along the golf course include:

(a) Rough — long grass and weeds (dark green and brown).

Penalty — Place playing piece in the Rough but within the same move space. Subtract one number (one dot) from the dice roll on your next turn, or play one Skill Card and remain inside the light green Fairway.

(b) Sand Traps — areas of sand (white with black dots).

Penalty — Place playing piece in the Sand Trap but within the same move space. Subtract two numbers (two dots) from the dice roll on your next turn, or play one Skill Card and remain outside the Sand Trap.

(c) Lakes (blue), Rivers (dark blue), and Woods (green trees)

Lost Ball Penalty — Player must add one stroke to his score for that hole and place his playing piece in the hazard but within the same move space, or play one Skill Card and remain outside the hazard.

(d) Out of Playing Area — This may occur when approaching the Green and rolling a high enough number on the dice to overshoot the Green (dark green), surrounding Fairway (light green), and land outside the playing area. A Skill Card may not be used to move back onto the playing area. The lost ball penalty applies here and the player must add one stroke to his score. He then places his piece in the first playing space adjacent to where his ball left the playing area. The dice are then rolled again and the player moves back toward the Green taking all hazards into account.

(e) Out of Bounds — An area within the playing field where one may not play his ball. It is designated by a white line.

Penalty — The player adds one stroke to his score and must return to his previous ball location or may play two Skill Cards and remain in the space adjacent to where he would have gone Out of Bounds.

Each player must deal with all hazards which occur within any playing space, where his playing piece lands.

Hazards are dealt with in the order of their penalties from greatest to least: (1) Out of Bounds, (2) Lakes, Rivers, Woods, (3) Sand Traps, and (4) Rough. It is not uncommon for two Rough penalties, two Lake penalties, or two Sand Trap penalties to share the same move space. Each penalty must be taken into account separately by spinning the hazard spinner. A player accepting the penalty for landing in a hazard (not using a Skill Card) does not have to spin for any other equal or lesser hazards within that playing space.

ON OR NOT ON THE GREEN

When a player lands on a playing space which includes any part of the Green (dark green putting surface) he must first spin to see if he has encountered any hazards. (One spin per hazard.) Having overcome the hazards he must then spin to see whether he is on or off the Green. If the spinner indicates that he is not on the Green (dark green putting surface), the player remains off the Green one space to the right or left of the dark green putting surface within the same playing space and rolls the dice again adding another stroke to his score; or he may play one Skill Card and move onto the Green within the same playing space.

THE GREEN AREA

The Green area is divided into squares to allow up and down or side to side movement on and around the putting surface. A playing piece approaching the Green from above or below the Green must spin for all hazards on either side (right or left) within the same playing space. A playing piece approaching the Green from either side of the Green must spin for all hazards above or below the putting surface within the same playing space, down to the red line. Hazards below the red line are not taken into account while the playing piece is around or on the Green area.

Playing pieces may not move diagonally on the Green.

ORDER OF PLAY

No more than one foursome (four players) may simultaneously play each hole. If more than four people play, they should divide as evenly as possible with half the group starting on the front nine (holes 1 to 9) and the other half starting on the back nine (holes 10 to 18).

The players decide who will tee off on the first hole. On every hole thereafter, playing order at the Tee is determined by each player's single hole score on the previous hole. Play goes from lowest to highest score. In the case of a tie the previous two or three holes' scores may have to be considered. On the Fairway (light green area between the Tee and the Green) playing order is determined by distance from the Green. The player farthest from the Green goes first and continues playing until he is no longer the farthest player from the Green. All players must be on the Green before anyone spins to putt. The players spin for putts according to the order in which they arrived on the Green (the last player to arrive on the Green putts first — the first player to arrive on the Green putts last).

THE PLAY

All players place their playing pieces on the Tee area and their stroke counters on zero.

One player begins by rolling one, two, or three dice or by playing a Skill Card and rolling four dice.

Adding the numbers on the dice he then moves his playing piece that many spaces towards the Green.

Once he has stopped, he then spins for any hazards in his playing space remembering to spin for the most difficult hazards first. If the spinner does not land on a hazard space for any of the hazards within the playing space, the player's turn ends. If the spinner does land on a hazard space, the player must either accept the penalty or use one or more Skill Cards and spin for any other hazards within the playing space. If he accepts the penalty he does not have to spin for other hazards in that space.

The player then counts his strokes and moves his stroke counter to the same number. His turn ends. He must wait until he is the player farthest from the Green before he can roll the dice and move again.

Each player takes his turn in the same way until all players are on the Green. (Remember to spin for on or off the Green after all hazards have been considered.) If in a vertical approach to the Green a hazard penalty is taken in a move space including the Green putting surface, the player must roll the dice again to move horizontally (right or left) toward the Green putting surface spinning for all hazards above and below to the red line. If the player does not encounter any more hazards, he must still spin to see if he is on or off the Green. If this player is still not on the Green after moving toward it horizontally (right or left), he must place his playing piece adjacent to the putting surface one space above or below in the same move space. He then rolls the dice again counting each roll of the dice as a stroke in his attempt to reach the Green. Again all hazards must be taken into account on either side (right or left) of the movement direction.

With each roll of the dice, all hazards in the same playing space must be considered. When all players are on the Green, each spins to find out the number of putts he takes. The number of putts each player takes is indicated by the numbers on the outside ring of the Hazard, Green and Putt Spinner.

Each player adds up his total strokes for that hole and tells the scorer. He then records each score in the appropriate space on the score card.

Players move their stroke counters back to zero and place their playing pieces on the Tee area for the next hole.

When all 18 holes have been played, the scorer totals each player's score. Any player with unused Skill Cards may subtract the number of cards from his total score making it lower. The lowest score wins!

BEST BALL

Protour lends itself well to the game of Best Ball. The rules of this game are the same as the regular game with the following exceptions:

(1) Best ball is played by teams. Each team consists of two players.

(2) The object Player B gets a 7 , Best Ball is to have the lowest single score on each hole. For example: Players A and B are competing against Players X and Y. Player A gets a score of 3 on the firsthole, Players B gets a 7, and both X and Y get a score of 4. The team of A and B would win that hole since Player A had the lowest score.

(3) After playing all 18 holes, each player counts his remaining Skill Cards and subtracts one stroke for each Skill Card. For example, if a player has only one Skill Card remaining, he would subtract a single stroke on (Handicap #1, hole 6). If a player has four Skill Cards remaining, he would subtract a single stroke on the first four handicap holes (6, 15, 3, and 18).

(4) After subtracting a stroke for each Skill Card as explained above, the winning score on each hole is circled. Each team counts its number of winning holes, and the team who has won the most holes is the winner.

(5) In the case of a tie, a sudden-death playoff would be played starting with hole #15. No Skill Cards are to be used during sudden death. The first team to win a hole is the winner. Sudden death is also played this way in the regular game of Protour.

COMPUTING THE HANDICAP

For players who wish to compute and play with a handicap, extra Skill Cards have been provided (up to 20 per player). Consult your local golf pro for information on handicap computation.

Players using their own handicap system will receive one Skill Card for each handicap point. The course rating may be considered to be Par 72.

SPECIAL NOTE

For large groups wishing to play more than eight people, extra spinners, score cards, and stroke counters may be obtained, so that as many as 72 people can play this game at once.

For convenience of illustration, score cards, marking pencils, and wiper cloths are not shown. The dice of FIG. 7 will have the usual six faces which are effectively numbered from 1 to 6. Yardage markings in FIG. 5 are representative only and are used for illustrative purposes.

A stroke card includes the pointer 25 which is conveniently movable so that a player may keep track of his strokes. A card 23 will be supplied each of the players.

But one spinner-card need be supplied to the players. It is noted that the "Not-on-Green" areas are small in relationship to the areas therebetween, indicating that there is only a slight chance. The average golfer will in fact be on the green for the average second or fairway shot, for example. The hazard areas H and 20 in FIG. 1 are also not in prominence, indicating that the average golfer may, but perhaps will not, stroke into a hazard area such as a sand trap. The specific areas arithmatically, of areas H can be determined in accordance with actual experience of a golfer on an open golf course.

On the outer periphery or border of the card are the series of numbers 0–4 indicating strokes as to putting. It is noted that there is a weighting, as to strokes 1–4, of 7, 12, 7, and 3 respectively. Accordingly, the numeral 1 appears at only seven instances whereas "2" appears in 12 instances. This is because the average golfer has a preponderance of a success experience of two putts for each green. These weightings are made in accordance with the average experiences of the average golfer on an outside course. Hazards are laid out as at 36 and 41 in FIG. 5, for example, so as to achieve realistic results.

Accordingly, what is provided is a new and improved golf game closely simulating outdoor experiences on an outdoor course. Chance elements are determined and selected to achieve a maximum reality for this indoor game as is possible.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. A golf game including in combination, plural game spendable each provided with indicia, defining a course including tee, rough, fairway, hazard, area-round-green, green, and hole areas, whereby to simulate a playing course, from tee to green and hole, of an outdoor golf course; mutually spaced grid markings disposed on said course at and proximate said green area; mutually spaced bar markings disposed on said course along said fairway area; a series of dice selected ones of which are rollable over a chosen one of said game boards for determining player marker advance for a particular stroke; a supply of means, individual pluralities of which are distributable to, and spendably by, individual players according to their individual handicaps, for advancing the respective players' play without stroke penalty; a series of player markers advanceable along said bar and grid markings; and a spinner-card having a card provided with an upper surface and a spinner pivoted to and above said upper surface, said upper surface being provided with hazard, not-on-green, and various stroke-number areas.

2. The combination of claim 1 wherein said game also includes a series of skill cards as said advancing means, stroke-counter means, and means for scoring said game.

3. The combination of claim 1 wherein series of dice provided for a particular play is correlated, as to number and face markings thereof, with said indicia, whereby to approximate anticipated strokes and distances on a corresponding outdoor course.

4. The combination of claim 1 wherein said stroke areas numbered 1, 2, 3, and 4 are weighted in the ratio of 7, 12, 7, 3.

* * * * *